US009436113B2

(12) United States Patent
Oki et al.

(10) Patent No.: US 9,436,113 B2
(45) Date of Patent: Sep. 6, 2016

(54) ELECTROSTATIC CHARGE IMAGE DEVELOPING TONER, LIQUID DEVELOPER, AND TONER CARTRIDGE

(71) Applicant: FUJI XEROX CO., LTD., Tokyo (JP)

(72) Inventors: Masahiro Oki, Kanagawa (JP); Akira Imai, Kanagawa (JP); Koji Horiba, Kanagawa (JP); Takako Kobayashi, Kanagawa (JP); Daisuke Yoshino, Kanagawa (JP); Yoshihiro Inaba, Kanagawa (JP); Hiroyuki Moriya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/811,537

(22) Filed: Jul. 28, 2015

(65) Prior Publication Data

US 2016/0187800 A1 Jun. 30, 2016

(30) Foreign Application Priority Data

Dec. 26, 2014 (JP) ..... 2014-265366

(51) Int. Cl.

| | |
|---|---|
| ***G03G 9/093*** | (2006.01) |
| ***G03G 9/13*** | (2006.01) |
| ***G03G 9/087*** | (2006.01) |

(52) U.S. Cl.
CPC ..... *G03G 9/132* (2013.01); *G03G 9/08708* (2013.01); *G03G 9/08755* (2013.01)

(58) Field of Classification Search
CPC ..... G03G 9/09307; G03G 9/09741; G03G 9/13
See application file for complete search history.

(56) References Cited

U.S. PATENT DOCUMENTS

| | | | | |
|---|---|---|---|---|
| 5,416,166 | A | 5/1995 | Yoo et al. | |
| 2008/0302470 | A1* | 12/2008 | Sumita et al. | G03G 15/6591 156/241 |
| 2010/0015543 | A1 | 1/2010 | Oki et al. | |

FOREIGN PATENT DOCUMENTS

| | | | |
|---|---|---|---|
| JP | S56-11461 | A | 2/1981 |
| JP | S61-122658 | A | 6/1986 |
| JP | S62-39879 | A | 2/1987 |
| JP | S62-242960 | A | 10/1987 |
| JP | 2620821 | B2 | 6/1997 |
| JP | 5115379 | B2 | 1/2013 |
| JP | 5287307 | B2 | 9/2013 |

* cited by examiner

*Primary Examiner* — Hoa V Le
(74) *Attorney, Agent, or Firm* — Oliff PLC

(57) ABSTRACT

An electrostatic charge image developing toner includes a toner particle that contains a binder resin and is surface-modified by a polymer obtained by polymerizing a monomer containing dicyandiamide and diethylenetriamine, wherein toner particles have positive charging properties.

18 Claims, 1 Drawing Sheet

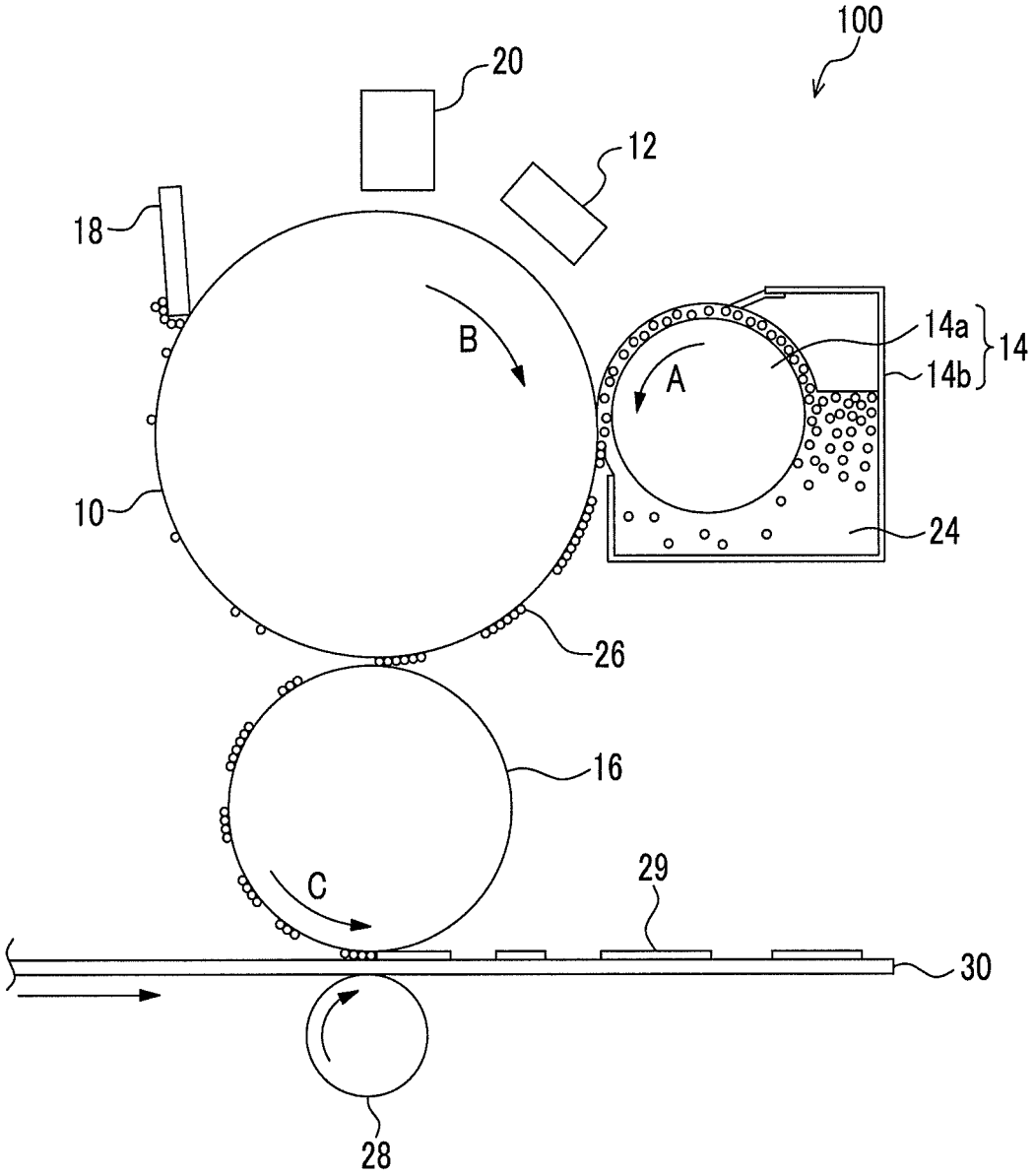
100
20
12
18
B
A
14a
14
14b
10
24
26
16
C
29
30
28

ELECTROSTATIC CHARGE IMAGE DEVELOPING TONER, LIQUID DEVELOPER, AND TONER CARTRIDGE

CROSS-REFERENCE TO RELATED APPLICATIONS

This application is based on and claims priority under 35 USC 119 from Japanese Patent Application No. 2014-265366 filed Dec. 26, 2014.

BACKGROUND

1. Technical Field

The present invention relates to an electrostatic charge image developing toner, a liquid developer, and a toner cartridge.

2. Related Art

A method of visualizing image information though an electrostatic charge image such as an electrophotography method is currently used in many fields. In the electrophotography method, a latent image (electrostatic latent image) is formed on an image holding member in charging and exposing processes (latent image forming process), and the latent image is visualized by developing an electrostatic latent image with an electrostatic charge image developer (hereinafter, simply referred to as a "developer" in some cases) including a toner for developing for an electrostatic charge image (hereinafter, simply referred to as a "toner" in some cases) (development process), and performing a transfer process and a fixation process. As a developer used in a dry development method, a two-component developer made with a toner and a carrier, and a single component developer in which a magnetic toner or a non-magnetic toner is singly used are included.

Meanwhile, a liquid developer used in a wet development method is obtained by dispersing toner particles in an insulating carrier liquid. A type in which toner particles including a thermoplastic resin in a volatile carrier liquid are dispersed, a type in which toner particles including a thermoplastic resin in a hardly volatile carrier liquid are dispersed, and the like are known.

SUMMARY

According to an aspect of the invention, there is provided an electrostatic charge image developing toner including:

a toner particle that contains a binder resin and is surface-modified by a polymer obtained by polymerizing a monomer containing dicyandiamide and diethylenetriamine, wherein the toner particle have positive charge.

BRIEF DESCRIPTION OF THE DRAWINGS

Exemplary embodiments of the present invention will be described in detail based on the following figures, wherein:

FIG. 1 is a diagram schematically illustrating a configuration of an image forming apparatus according to an exemplary embodiment of the invention.

DETAILED DESCRIPTION

Exemplary embodiments of the invention are described below. The exemplary embodiments are provided as examples, and the invention is not limited thereto.

Electrostatic Charge Image Developing Toner

A electrostatic charge image developing toner (hereinafter, also simply referred to as a "toner") according to the exemplary embodiment of the invention contains toner particles that contain at least a binder resin and are surface-modified by a polymer of a monomer (hereinafter, also simply referred to as a "DCDA/DETA polymer") which contains dicyandiamide and diethylenetriamine. The toner particles may include other components such as a colorant or a release agent as necessary.

The binder resin which is generally used in the toner is a polyester resin or a styrene/acrylic resin, but they are easily negatively charged, and the polyester resin has excellent fixing properties and excellent color developing properties so that tends to be negatively charged particularly easily. In addition, if a silicone carrier liquid and a polyester resin having excellent fixing properties are combined as the liquid developer, the liquid developer is not likely to be positively charged.

The charging mechanism of the liquid development is basically different from a mechanism of the dry toner using the friction charging. The general positive charging mechanism in the liquid development is to positively charge toner particles themselves by causing protons intentionally introduced to the carrier liquid to be adsorbed onto proton receiving layers on the surfaces of the toner particles. Therefore, the design of the proton receiving layers on the surfaces of the toner particles becomes very important, and the design thereof determines the characteristics of the liquid developer. However, in the liquid developer according to the related art, melted and kneaded dispersions are mixed into a carrier so that a dispersion agent, a charge controlling agent, and the like are added to be turned into developing liquids by bead mills or the like. Therefore, it is difficult to intentionally provide the proton receiving layers on the surfaces of the toner particles, and moreover, there are problems that there are not many kinds of materials that may be used as the dispersion agents, the charge controlling agents, and the like, and the solubility in the carrier liquid is low.

As the commercially available positive charge controlling agent, a nigrosine dye, such as "BONTRON N-01", "BONTRON N-04", and "BONTRON N-07" (hereinbefore, manufactured by Orient Chemical Industries Co., Ltd.), "CHUO CCA-3" (manufactured by Chuo Synthetic Chemical Co., Ltd.); a triphenylmethane dye containing tertiary amine as a branch; a quaternary ammonium salt compound such as "BONTRON P-51" (manufactured by Orient Chemical Industries Co., Ltd.), or "TP-415" (manufactured by Hodogaya Chemical Co., Ltd.), and cetyltrimetylammonium bromide such as "COPY CHARGE PX VP435" (manufactured by Clariant, Ltd.) are included. However, the charge controlling agent that may be applied to a color toner is only a colorless quaternary ammonium salt compound, and since the others are colored, they may be applied to only a black color toner. In addition, the positive charge controlling agent as described above may be effective when being applied to a dry toner, but is not likely effective when being applied to a liquid toner. As the charge controlling agent for positive charging for a liquid toner, an amine material such as SOLSPERSE 13940/11200, ANTARON V220, or ANTARON V216 (α-olefin/vinylpyrrolidone copolymer) is added in many cases, but types of applicable materials are very few and the solubility in the carrier liquid is low, and thus sufficient positive charging properties are unlikely to be obtained.

The charging of the toner for a liquid developer may be controlled by adding an amine material such as SOLSPERSE 13940, SOLSPERSE 11200, ANTARON V220, and ANTARON 216 when the developing liquid is formed. However, types of applicable materials are very few, and sufficient charging properties may not be obtained especially when silicone oil is used as the carrier liquid. In addition, according to the method in the related art, the charge controlling material is added when melting and kneading are performed or when the developing liquid is manufactured by using a dispersion device such as a bead mill. However, according to this method, the charge controlling material is easily separated from the surfaces of the toner particles, and charging stability is low.

The present inventors have found that a dry toner or a toner for a liquid developer having excellent positive charging properties is realized by surface-modifying the surface of toner particles using a DCDA/DETA polymer. It is considered that toner particles tend to be positively charged because the DCDA/DETA polymer is highly cationic substance and functions as a proton receiving layer when the DCDA/DETA polymer exists on the surface of the toner particles. It is considered that the possibility that the DCDA/DETA polymer is separated from the surface of the toner particles becomes extremely low by the DCDA/DETA polymer being chemically adsorbed by the surface of the toner particles utilizing an acid-base reaction, thereby obtaining stabilized positive charging properties. Further, it is considered that the surface of toner particles is unlikely to be affected by charge of a binder resin or a colorant because the surface thereof is covered by the DCDA/DETA polymer. Accordingly, the positive charging may be performed even by combining a silicone carrier liquid and the binder resin such as a polyester resin which is not likely to be positively charged is used as a liquid developer. Since the DCDA/DETA polymer is nearly colorless and transparent, the DCDA/DETA polymer may be developed to a color toner.

Polymer of monomer containing dicyandiamide and diethylenetriamine (DCDA/DETA polymer)

The DCDA/DETA polymer is a polymer containing at least dicyandiamide ($H_2N—CNH—NH—CN$) and diethylenetriamine ($H_2N—C_2H_4—NH—C_2H_4—NH_2$) as a constituent monomer. The DCDA/DETA polymer may be obtained, for example, by mixing 1 mole of dicyandiamide, 1 mole of diethylenetriamine, and 0.1 mole of ammonium chloride, heating the mixture to a temperature of 140° C., and stirring the mixture for 10 hours.

The DCDA/DETA polymer may contain a monomer such as formaldehyde or the like in addition to dicyandiamide and diethylenetriamine as a constituent monomer.

In the DCDA/DETA polymer, the molar ratio of dicyandiamide to diethylenetriamine is in the range of from 1:0.1 to 1:10.

The DCDA/DETA polymer may include a salt structure having a counter ion in an amino group ($—NH_2$) moiety. Examples of the counter ion include a sulfate ion ($SO_4^{2-}$), an acetate ion ($CH_3COO$), and a phosphate ion ($PO_4^{3-}$). Among these, from a viewpoint of excellent positive charging properties, it is preferable that the counter ion is at least one of an acetate ion and a phosphate ion. Further, when the counter ion is at least one of an acetate ion and a phosphate ion, the DCDA/DETA polymer has excellent developing properties, dispersion stability to a carrier liquid, and recycling properties.

It is preferable that the DCDA/DETA polymer is alkaline. It is considered that an acid-base reaction with the acidic surface of toner particles is likely to be caused and chemical adsorption occurs when the DCDA/DETA polymer is alkaline. In this case, the pH of a solution where the DCDA/DETA polymer is dissolved in water is preferably greater than 7 and more preferably 10 or greater.

A commercially available material may be used as the DCDA/DETA polymer. Examples of the commercially available DCDA/DETA polymer include UNISENSE KHP10LU, KHP11LU, and KHP12LU (hereinbefore, the counter ion is a sulfate ion), KHP20LU (the counter ion is an acetate ion), and KHP21LU (the counter ion is a phosphate ion) (all manufactured by SENKA Corporation).

The content of the DCDA/DETA polymer is preferably in the range of from 0.2% by weight to 3% by weight and more preferably in the range of from 0.2% by weight to 1.0% by weight with respect to the entirety of the toner particles. When the content of the DCDA/DETA polymer is less than 0.2% by weight, sufficient positive charging properties cannot be obtained, developing properties are deteriorated, and dispersion stability and recycling properties are deteriorated when used as a liquid developer in some cases. Further, when the content of the DCDA/DETA polymer exceeds 3% by weight, the toner is unlikely to be transferred from the photoreceptor because of excessively strong positive charging properties, the developing properties are deteriorated, and the dispersion stability and the recycling properties are deteriorated when used as a liquid developer in some cases.

As the method of preparing the DCDA/DETA polymer, a method of mixing dicyandiamide, diethylenetriamine, and ammonium chloride, heating the mixture in a temperature range of from 100° C. to 180° C., for example, 140° C., stirring the mixture for 1 hour to 20 hours, for example, 10 hours, and obtaining a dicyandiamide and diethylenetriamine condensate is exemplified.

Binder Resin

The binder resin is not particularly limited, but, for example, polyester, polystyrene, a styrene-acrylic resin such as a styrene-alkyl acrylate copolymer or a styrene-alkyl methacrylate copolymer, a styrene-acrylonitrile copolymer, a styrene-butadiene copolymer, a styrene-maleic anhydride copolymer, polyethylene, and polypropylene are included. Further, polyurethane, an epoxy resin, a silicone resin, polyamide, modified rosin, paraffin wax, and the like are included. Among them, in view of fixing properties, a polyester resin and a styrene-acrylic resin are preferable, and a polyester resin is more preferable. The binder resins may be used singly, or two or more kinds thereof may be used by mixture.

As described above, the binder resin preferably includes a polyester resin as a main component. The polyester resin is obtained by synthesizing an acid (polyvalent carboxylic acid) component and an alcohol (polyol) component. According to the exemplary embodiment, an "acid-derived structural component" refers to a structural portion which is an acid component before a polyester resin is synthesized, and an "alcohol-derived structural component" refers to a structural portion which is an alcohol component before the polyester resin is synthesized. A main component refers to a component that is equal to or greater than 50 parts by weight with respect to 100 parts by weight of the binder resin in the toner particles.

Acid-Derived Structural Component

The acid-derived structural component is not particularly limited, and an aliphatic dicarboxylic acid and an aromatic carboxylic acid are preferably used. As the aliphatic dicarboxylic acid, for example, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, or lower alkyl esters thereof or acid anhydrides thereof are included, but is not limited thereto. In addition, as the aromatic carboxylic acid, for example, lower alkyl esters or anhydrides of an aromatic carboxylic acid such as terephthalic acid, isophthalate, anhydrous phthalic acid, anhydrous trimellitic acid, anhydrous pyromellitic acid, and naphthalene dicarboxylic acid are included. In addition, an alicyclic carboxylic acid such as a cyclohexanedicarboxylic acid is included. Further, it is preferable to use carboxylic acids of trivalent or higher valent (trimellitic acids or acid anhydrides thereof or the like) together with the dicarboxylic acid in order to obtain a crosslinked structure or a branched structure for securing good fixing properties. In addition, specific examples of alkenylsuccinic acids described above include dodecenylsuccinic acid, dodecylsuccinic acid, stearylsuccinic acid, octylsuccinic acid, octenylsuccinic acid, and the like.

Alcohol-Derived Structural Component

The alcohol-derived structural component is not particularly limited, and aliphatic diol, for example, ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol are included. In addition, diethyleneglycol, triethyleneglycol, neopentylglycol, glycerin, alicyclic diols such as cyclohexanediol, cyclohexanedimethanol, and hydrogenated bisphenol A, and aromatic diols such as an ethyleneoxide adduct of bisphenol A and a propyleneoxide adduct of bisphenol A are used. In addition, in order to obtain a crosslinked structure or a branched structure for securing good fixing properties, polyol of trivalent or higher valent (glycerin, trimethylolpropane, pentaerythritol) may be used together with diol.

The method of preparing the polyester resin is not particularly limited, and the polyester resin may be prepared in a general polyester polymerization method in which an acid component and an alcohol component are reacted. For example, direct polycondensation and an ester exchanging method are included, and the preparing method may be used depending on types of monomers. When the acid component and the alcohol component are reacted, a molar ratio (acid component/alcohol component) is different depending on reaction conditions, but is generally about 1/1.

The polyester resin may be prepared in the temperature range of from 180° C. to 230° C., and the reaction may be performed while the reaction system is decompressed, if necessary, and water or alcohol generated at the time of the condensation is removed. If the monomer is not dissolved or compatible under the reaction temperature, a polymerization reaction becomes partially fast or slow so as to generate a lot of uncolored particles. Therefore, a solvent with a high boiling point may be added and dissolved as a solubilizing agent.

The polycondensation reaction may be performed while a solubilizing solvent is distilled. In the copolymerization reaction, if a poorly compatible monomer exists, the poorly compatible monomer and acid or alcohol to be polycondensed with the monomer are condensed in advance, and then the polycondensation may be performed with the main component.

As the catalyst which may be used in the preparing of the polyester resin, an alkali metal compound such as sodium and lithium; an alkaline-earth metal compound such as magnesium or calcium; a metal compound such as zinc, manganese, antimony, titanium, tin, zirconium, or germanium; a phosphoric acid compound, a phosphorous acid compound, and an amine compound, and the like are included. Among them, for example, a tin containing catalyst such as tin, tin formate, tin oxalate, tetraphenyl tin, dibutyltin dichloride, dibutyltin oxide, or diphenyltin oxide is preferably used.

According to the exemplary embodiment, as a resin for an electrostatic charge image developing toner, a compound with a hydrophilic polar group is used, as long as the compound may be copolymerized. Specifically, if the resin used is polyester, a dicarboxylic acid compound in which a sulphonyl group is directly substituted for an aromatic ring such as sulphonyl-terephthalic acid sodium salt, and 3-sulphonyl isophthalic acid sodium salt are included.

A weight average molecular weight Mw of the polyester resin is preferably equal to or greater than 5,000, and more preferably in the range of from 5,000 to 50,000. If the polyester resin is included, friction sliding properties are superior. If the weight average molecular weight Mw of the polyester resin is less than 5,000, the polyester resin is easily separated, and thus problems caused by isolated resins (filming, increase of fine powders caused by fragility, deterioration of powder flow characteristic, and the like) may occur depending on the circumstances.

In the toner according to the exemplary embodiment, a resin other than the polyester resin is not particularly limited, and specifically, a homopolymer of monomers such as styrenes such as styrene, p-chlorostyrene, or α-methylstyrene; an acrylic monomer such as methyl acrylate, ethyl acrylate, n-propyl acrylate, butyl acrylate, lauryl acrylate, or 2-ethylhexyl acrylate; a methacrylic monomer such as methyl methacrylate, ethyl methacrylate, n-propyl methacrylate, lauryl methacrylate, or 2-ethylhexyl methacrylate; an ethylene unsaturated acid monomer such as acrylic acid, methacrylic acid, or sodium styrenesulfonate; vinyl nitriles such as acrylonitrile or methacrylonitrile; vinyl ethers such as vinyl methyl ether or vinyl isobutyl ether; vinyl ketones such as vinyl methyl ketone, vinyl ethyl ketone, or vinyl isopropenyl ketone; an olefin monomer such as ethylene, propylene, or butadiene, a copolymer obtained by combining two or more types of these monomers, or a mixture thereof, a non-vinyl condensation resin such as an epoxy resin, a polyester resin, a polyurethane resin, a polyamide resin, a cellulose resin, and a polyether resin, a mixture of the vinyl resin with these, or a graft polymer obtained by polymerizing a vinyl monomer under coexistence of these is included. The resins may be used singly, or two or more types thereof may be used in combination.

The content of the binder resin is, for example, in the range of from 65% by weight to 95% by weight with respect to all toner particles.

An acid value of the binder resin is preferably in the range of from 1 mgKOH/g to 30 mgKOH/g, and more preferably in the range of from 7 mgKOH/g to 20 mgKOH/g. When the acid value of the binder resin is less than 1 mgKOH/g, a desired positive charge amount cannot be obtained because of a decrease in the amount of the DCDA/DETA polymer, which is used as a surface modifier, to be adsorbed by the surface of the toner particles or granulating properties are deteriorated at the time of granulation using phase inversion emulsification in some cases. When the acid value of the binder resin is greater than 30 mgKOH/g, the positive charging properties are prevented even if the DCDA/DETA polymer is adsorbed by the surface of the toner particles.

Other Components

The toner particles according to the exemplary embodiment may include a colorant, and also additives such as a release agent, a charge controlling agent, silica powder, and metal oxide, if necessary. These additives may be internally added by being kneaded and mixed into the binder resin, or be externally added by performing a mixing process after toner particles are obtained as the particles.

The colorant is not particularly limited, and a well-known pigment is used, and a well-known dye may be added, if necessary. Specifically, respective pigments such as yellow, magenta, cyan, and black are used.

As the yellow pigment, a compound represented by a condensed azo compound, an isoindolinone compound, an anthraquinone compound, an azo metal complex compound, a methane compound, an allyl amide compound, and the like are used.

As the magenta pigment, a condensed azo compound, a diketopyrrolopyrrole compound, anthraquinone, a quinacridone compound, a basic dye lake compound, a naphthol compound, a benzimidazolone compound, a thioindigo compound, a perylene compound, and the like are used.

As the cyan pigment, a copper phthalocyanine compound and a derivative thereof, an anthraquinone compound, a basic dye lake compound, and the like are used.

As the black pigment, carbon black, aniline black, acetylene black, iron black, and the like are used:

The content of the colorant is, for example, in the range of from 1% by weight to 20% by weight with respect to all toner particles.

The release agent is not particularly limited, and, for example, vegetable wax such as carnauba wax, Japan wax, and rice bran wax; animal wax such as beeswax, insect wax, whale wax, and wool wax; mineral wax such as montan wax and ozoketrite, Fischer Tropsch Wax (FT wax) having ester in a branch, synthesized fatty acid solid ester wax such as special fatty acid ester and polyol ester; and synthetic wax such as paraffin wax, polyethylene wax, polypropylene wax, polytetrafluoroethylene wax, polyamide wax, and a silicone compound; and the like are included. The release agents may be used singly, or two or more types thereof may be used in combination.

The content of the release agent is, for example, in the range of from 0.1% by weight to 15% by weight with respect to all toner particles.

The charge controlling agent is not particularly limited, and a well-known charge controlling agent in the related art is used. For example, a positive charge controlling agent such as a nigrosine dye, a fatty acid-modified nigrosine dye, a carboxyl group containing fatty acid-modified nigrosine dye, quaternary ammonium salt, an amine compound, an amide compound, an imide compound, and an organic metal compound; and a negative charge controlling agent such as a metal complex of oxycarboxylic acid, a metal complex of azo compound, a metal complex salt dye, and a salicylic acid derivative; are included. The charge controlling agent may be used singly, or two or more types thereof may be used in combination.

The metal oxide is not particularly limited, and, for example, titanium oxide, aluminum oxide, magnesium oxide, zinc oxide, strontium titaniate, barium titaniate, magnesium titaniate, and calcium titaniate are included. The metal oxides may be used singly, or two or more types thereof may be used in combination.

Method of Preparing Toner Particles

The method of preparing toner particles used in the exemplary embodiment is not particularly limited, and, for example, a wet preparing method such as a kneading and pulverizing method, an in-liquid emulsifying method, or a polymerization method is included.

For example, a binder resin, if necessary, a colorant, and other additives are put and mixed in a mixing device such as a HENSCHEL mixer, are melted and kneaded with a twin screw extruder, a BANBURY mixer, a roll mill, a kneader, and the like, are cooled with a drum flaker, are coarsely grinded with a grinder such as a hammer mill, are further pulverized with a pulverizer such as a jet mill, and are classified with an air classifier or the like so that a pulverized toner is obtained.

In addition, an in-liquid emulsified dry toner may be obtained by filtering and drying particles obtained by dissolving the binder resin, and if necessary, the colorant, and other additives in a solvent such as ethyl acetate, emulsifying and suspending the resultant in water in which a dispersion stabilizer such as calcium carbonate is added, removing the solvent, and then removing a dispersion stabilizing agent.

In addition, the polymerized toner may be obtained by adding and granulating a composition containing a polymerizable monomer that forms the binder resin, a colorant, a polymerization initiating agent (for example, benzoyl peroxide, lauryl peroxide, isopropyl peroxycarbonate, cumene hydroperoxide, 2, 4-dichlorobenzoyl peroxide, and methyl ethyl ketone peroxide), other additives, and the like in water phase while stirring, performing polymerization, filtering particles, and drying the particles.

In addition, the combination ratio of respective materials (binder resin, colorant, other additives, and the like) at the time of obtaining the toner may be set depending on required characteristics, low temperature fixing properties, colors, and the like. The toner particles for a liquid developer according to the exemplary embodiment may be obtained by grinding the obtained toner in carrier oil by using a well-known grinding apparatus such as a ball mill, a bead mill, and a high-pressure wet atomizing apparatus.

Surface-Modifying Method

The surface modified toner particles according to the exemplary embodiment of the invention are prepared using a method including a process of surface-modifying the toner particles by the DCDA/DETA polymer and forming a layer of the DCDA/DETA polymer that covers the surface of the toner particles. Since the DCDA/DETA polymer is a water-soluble polymer, the DCDA/DETA polymer may be adsorbed by the surface of the toner particles after washing with water and before performing a drying process in the wet preparation method carrying out granulation in a liquid. In a specific treatment method, the pH of a slurry of washed toner particles is adjusted to be within a range of from 3 to 5, the surface of the toner particles is allowed to enter an acidic state, an excessive amount of acids are washed with ion exchange water or the like to be removed, the DCDA/DETA polymer is added to the slurry, and the DCDA/DETA polymer chemisorbs on the surface of the toner particles, through an acid-base reaction. Subsequently, the unreacted DCDA/DETA polymer may be removed by performing washing using an ion exchange water or the like.

Specifically, the surface modification of the toner particles is performed by the following method.

(1) Acids (approximately 1 N of hydrochloric acid or nitric acid) are added to a slurry containing toner particles and water such that the pH thereof is adjusted to be in the range of from 2 to 5, and an acid site on the surface of the toner particles are returned to acid.

(2) Solid-liquid separation is performed by washing using ion exchange water or centrifugation so that extra acids are removed.

(3) After re-slurry, a water-soluble DCDA/DETA polymer is added and the mixture is stirred in a liquid temperature range of from 20° C. to 35° C. for about 30 minutes to 60 minutes.

(4) After solid-liquid separation is performed by washing using ion exchange water or centrifugation or the like and an extra DCDA/DETA polymer is removed (for example, the conductivity thereof becomes about 20 μS/cm or less)

(5) After filtration, the resultant is dried (for example, approximately 35° C. for 24 hours at minimum, moisture content: 1% or less) and crushed.

When the polyester resin with the acid value of about 10 is used as the binder resin of the toner particles, and the toner particles are granulated by using phase inversion emulsification, since the filtrate after washing is alkaline, it is considered that acid sites on the surfaces of the toner particles (for example, a —COOH group) are neutralized, and many portions of the toner particles have salt structures (for example, $—COO^-Na^+$ and $—COO^-NH_4^+$). Therefore, it is preferable that the salt structure on the surface of toner particles are return to acids (for example, a —COOH group) by performing a process (1) and the DCDA/DETA polymer is allowed to be easily adsorbed through an acid-base reaction. However, the process (1) or (2) is not essential, and may be omitted if a desired positive charge amount may be obtained.

Characteristics of Toner Particles

A volume average particle diameter of toners for positive charging according to the exemplary embodiment is preferably in the range of from 3 μm to 8 μm, and more preferably in the range of from 3 μm to 7 μm. In addition, a number average particle diameter is preferably in the range of from 2 μm to 7 μm, and more preferably in the range of from 2 μm to 6 μm.

The volume average particle diameter and the number average particle diameter are measured by using COULTER MULTISITE II (manufactured by Beckman Coulter Inc.) with an aperture diameter of 50 μm. At this point, the measurement is performed after the toner is dispersed in an electrolyte aqueous solution (ISOTON aqueous solution) for 30 seconds with supersonic waves.

Developer

A dry developer according to the exemplary embodiment is not particularly limited as long as the dry developer contains the electrostatic charge image developing toner according to the exemplary embodiment, and may be composed with proper components according to purpose. The developer according to the exemplary embodiment becomes a single component developer if the electrostatic charge image developing toner is used singly, and becomes a two-component developer if the electrostatic charge image developing toner is used in combination with a carrier.

For example, if the carrier is used, the carrier is not particularly limited. Well-known carriers themselves are included, for example, well-known carriers such as resin coated carriers disclosed in JP-A-62-39879, and JP-A-56-11461 are included.

As specific examples of carriers, the following resin-coated carriers are included. As core particles of the carrier, general iron powder, ferrite, magnetite molded article, and the like are included; the volume average particle diameter thereof is in the range of from about 30 μm to 200 μm.

In addition, as the coating resin of the resin coated carrier, for example, homopolymer such as styrenes such as styrene, p-chlorostyrene, and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acryls such as dimethylaminoethyl methacrylate; vinyl nitriles such as acrylonitrile and methacrylonitrile; vinylpyridines such as 2-vinylpyridine and 4-vinylpyridine; vinyl ethers such as vinyl methyl ether and vinyl isobutyl ether; vinyl ketones such as vinylmethylketone, vinylethylketone, and vinyl isopropenyl ketone; olefins such as ethylene and propylene; and vinyl fluorine-containing monomer such as vinylidene fluoride, tetrafluoro ethylene, and hexafluoro ethylene; and copolymers formed of two or more types thereof are included. Further, a silicone resin including methyl silicone, or methyl phenyl silicone, polyesters containing bisphenol and glycol, an epoxy resin, a polyurethane resin, a polyamide resin, a cellulose resin, a polyether resin, and a polycarbonate resin are included. These resins may be used singly or two or more types thereof may be used in combination. A coating amount of the coating resin is preferably in the range of from 0.1 parts by weight to 10 parts by weight with respect to 100 parts by weight of the core particles, and more preferably in the range of from 0.5 parts by weight to 3.0 parts by weight.

In the preparation of the carrier, a heating-type kneader, a heating-type HENSCHEL mixer, a UM mixer, and the like may be used. According to an amount of the coating resin, a heating-type fluidized tumbling bed, a heating-type kiln, and the like may be used.

The mixing ratio between the electrostatic charge image developing toner according to the exemplary embodiment and the carrier in the developer is not particularly limited, and may be appropriately selected according to a purpose.

Liquid Developer

The liquid developer according to the exemplary embodiment is not particularly limited as long as the liquid developer contains the electrostatic charge image developing toner according to the exemplary embodiment and a carrier liquid, and may be composed with proper components according to a purpose.

Carrier Liquid

A carrier liquid is an insulating liquid for dispersing toner particles, and is not particularly limited. For example, aliphatic hydrocarbon solvent including aliphatic hydrocarbon such as paraffin oil as a main component (MORESCO WHITE MT-30P, MORESCO WHITE P40, and MORESCO WHITE P70 manufactured by Matsumura Oil Co., Ltd., ISOPAR L and ISOPAR M manufactured by Exxon Chemical Co., Ltd. and the like, as commercially available products), a hydrocarbon solvent such as natphthene oil (EXXSOL D80, EXXSOL DUO, and EXXSOL D130 manufactured by Exxon Chemical Co., Ltd., and NAPHTHESOL L, NAPHTHESOL M, NAPHTHESOL H, NEW NAPHTHESOL 160, NEW NAPHTHESOL 200, NEW NAPHTHESOL 220, and NEW NAPHTHESOL MS-20P manufactured by Nippon Petrochemicals Co., Ltd. as commercially available products) are included. An aromatic compound such as toluene and the like may be contained therein.

In addition, silicone oil such as dimethyl silicone, methyl phenyl silicone, and methylhydrogen silicone (silicone solvent) are included. Among these, in view of securing image intensity, silicone oil is preferable.

The carrier liquid included in the liquid developer according to the exemplary embodiment may be one type, or maybe two or more types. If two or more types of carrier liquids are used as a mixture, a mixture of a paraffin solvent and vegetable oil and a mixture of a silicone solvent and vegetable oil are included.

For example, the volume resistivity of the carrier liquid is included in the range of from $1.0\times10^{10}$ Ω·cm to $1.0\times10^{14}$ Ω·cm, and may be in the range of from $1.0\times10^{10}$ Ω·cm to $1.0\times10^{13}$ Ω·cm.

The carrier liquid may include various types of auxiliary materials, for example, a dispersion agent, an emulsifying agent, a surfactant, a stabilizing agent, a wetting agent, a thickening agent, a foaming agent, an antifoaming agent, a coagulant, a gelling agent, an anti-settling agent, a charge controlling agent, an antistatic agent, an antioxidant, a softening agent, a plasticizer, a filler, a flavoring agent, an adhesion-preventing agent, and a release agent.

Method of Preparing Liquid Developer

The liquid developer according to the exemplary embodiment may be obtained by mixing and pulverizing the toner particles and a carrier liquid using a disperser such as a ball mill, a sand mill, an attritor, and a bead mill and dispersing the toner particles in the carrier liquid. In addition, the dispersion of the toner particles in the carrier liquid is not limited to the disperser, and the dispersion may be performed by rotating special stirring blades at a high speed, by shearing force of a rotor and stator known as a homogenizer, or by ultrasonic waves.

In view of appropriately controlling a viscosity of the developer and smoothly circulating the developing liquid in a developing machine, a concentration of the toner particles in the carrier liquid is preferable in the range of from 0.5% by weight to 40% by weight, and more preferably in the range of from 1% by weight to 30% by weight.

Thereafter, the obtained dispersion is filtered with a filter such as a membrane filter with a pore diameter of about 100 μm to remove waste and coarse particles.

Developer Cartridge, Process Cartridge, and Image Forming Apparatus

An image forming apparatus according to the exemplary embodiment includes, for example, an image holding member (hereinafter, also referred to as a "photoreceptor"), a charging unit that charges a surface of the image holding member, a latent image forming unit that forms a latent image (electrostatic latent image) on a surface of the image holding member, a development unit that develops the latent image formed on the surface of the image holding member by a liquid developer or a developer according to the exemplary embodiment to forma toner image, a transfer unit that transfers the toner image formed on the surface of the image holding member to a recording medium, and a fixation unit that forms a fixed image by causing the toner image transferred to the recording medium to be fixed.

In addition, a method of forming an image according to the exemplary embodiment includes, for example, a latent image forming process that forms a latent image on a surface of an image holding member, a development process of forming a toner image by developing the latent image formed on the surface of the image holding member with a liquid developer or a developer according to the exemplary embodiment, a transfer process of transferring the toner image formed on the surface of the image holding member to a recording medium, and a fixation process of forming a fixed image by causing the toner image transferred to the recording medium to be fixed on the recording medium.

The image forming apparatus, for example, a cartridge structure (process cartridge) in which a portion including a development unit is detachable from a main body of the image forming apparatus. The process cartridge is not particularly limited as long as the process cartridge stores the liquid developer or the developer according to the exemplary embodiment. The process cartridge stores the liquid developer and the developer according to the exemplary embodiment, includes a development unit that develops the latent image formed on the image holding member with the liquid developer or the developer and forms the toner image, and is detachable from the image forming apparatus.

In addition, the developer cartridge according to the exemplary embodiment is not particularly limited as long as the developer cartridge receives the liquid developer or the developer according to the exemplary embodiment. The developer cartridge receives the liquid developer or the developer according to the exemplary embodiment, and is detachable from an image forming apparatus including the development unit that forms a toner image by developing the latent image formed on the image holding member with the liquid developer.

Hereinafter, the image forming apparatus using the liquid developer according to the exemplary embodiment is described as an example with reference to the drawings, but the invention is not limited to this configuration.

FIG. 1 is a diagram schematically illustrating a configuration of an exemplary image forming apparatus according to the exemplary embodiment. An image forming apparatus 100 includes a photoreceptor (image holding member) 10, charging device (charging unit) 20, an exposure device (latent image forming unit) 12, a developing device (development unit) 14, an intermediate transfer member (transfer unit) 16, a cleaner (sweeping unit) 18, and a transfer fixation roller (transfer unit, fixation unit) 28. The photoreceptor 10 has a cylindrical shape, and the charging device 20, the exposure device 12, the developing device 14, the intermediate transfer member 16, and the cleaner 18 are sequentially provided on the circumference of the photoreceptor 10.

Hereinafter, operations of the image forming apparatus 100 are described.

The charging device 20 charges the surface of the photoreceptor 10 to a predetermined potential (charging process), and the exposure device 12 forms a latent image (electrostatic latent image) by exposing the charged surface with laser beam based on an image signal (latent image forming process).

The developing device 14 includes a developing roller 14*a* and a developer receiving container 14*b*. The developing roller 14*a* is installed so that a portion thereof is immersed in a liquid developer 24 received in the developer receiving container 14*b*. The liquid developer 24 includes toner particles including insulating carrier liquid, and binder resins.

Though the toner particles are dispersed in the liquid developer 24, for example, the positional variation of concentrations of the toner particles in the liquid developer 24 is decreased, for example, by continuously stirring the liquid developer 24 with a stirring member provided in the developer receiving container 14*b*. Accordingly, the liquid developer 24 in which the positional variation of the concentrations of the toner particles is decreased is supplied to the developing roller 14*a* that rotates in an arrow A direction in FIG. 1.

The liquid developer 24 supplied to the developing roller 14*a* is transferred to the photoreceptor 10 in a state of being regulated to a certain supply amount by a regulation member, and is supplied to the electrostatic latent image in a position in which the developing roller 14*a* and the photoreceptor 10 are close to each other (or contact with each other). Accordingly, the electrostatic latent image is developed to become a toner image 26 (development process).

The developed toner image 26 is conveyed to the photoreceptor 10 that rotates in an arrow B direction in FIG. 1, and is transferred to a paper (recording medium) 30. However, according to the exemplary embodiment, before the toner image is transferred to the paper 30, in order to enhance the transfer efficiency to the recording medium together with the separation efficiency of the toner image from the photoreceptor 10 and to cause the toner image to be fixed at the same time as being transferred to the recording medium, the toner image is once transferred to the intermediate transfer member 16 (intermediate transfer process). At this point, the circumferential speed between the photoreceptor 10 and the intermediate transfer member 16 may be provided.

Subsequently, the toner image conveyed in an arrow C direction by the intermediate transfer member 16 is fixed at the same time as being transferred to the paper 30 in a contact position with the transfer fixation roller 28 (transfer process and fixation process). The paper 30 is interposed between the transfer fixation roller 28 and the intermediate transfer member 16, and the toner image on the intermediate transfer member 16 is in close contact with the paper 30. Accordingly, the toner image is transferred to the paper 30, and the toner image is fixed on the paper, to be a fixed image 29. It is preferable that the toner image be fixed by providing a heating element on the transfer fixation roller 28 and pressurizing and heating the toner image. The fixation temperature is, generally, in the range of from 120° C. to 200° C.

If the intermediate transfer member 16 has a roller shape as illustrated in FIG. 1, the intermediate transfer member 16 and the transfer fixation roller 28 configure a roller pair. Therefore, the intermediate transfer member 16 and the transfer fixation roller 28 respectively correspond to a fixation roller and a pressurization roller in a fixation device, and exhibit a fixing function. That is, if the paper 30 passes through a nip formed between the intermediate transfer member 16 and the transfer fixation roller 28, the toner image is transferred and also is heated and pressurized with respect to the intermediate transfer member 16 by the transfer fixation roller 28. Accordingly, the toner image permeates into fibers of the paper 30 while the binder resins in the toner particles that configure the toner image are softened, so that the fixed image 29 is formed on the paper 30.

According to the exemplary embodiment, the image is transferred to and fixed on the paper 30 at the same time, but the transfer process and the fixation process may be respectively performed so that the image is fixed after being transferred. In this case, the transfer roller that transfers the toner image from the photoreceptor 10 has a function corresponding to the intermediate transfer member 16.

Meanwhile, in the photoreceptor 10 from which transfers the toner image 26 is transferred to the intermediate transfer member 16, remaining toner particles that are not transferred are moved to a contact position with the cleaner 18, and collected by the cleaner 18. In addition, if the transfer efficiency is near 100%, and the remaining toner does not cause problems, the cleaner 18 may not be provided.

The image forming apparatus 100 may include an erasing device (not illustrated) that erases the surface of the photoreceptor 10 after transfer and before next charging.

The charging device 20, the exposure device 12, the developing device 14, the intermediate transfer member 16, the transfer fixation roller 28, the cleaner 18, and the like included in the image forming apparatus 100 may all be operated in synchronization with the rotation speed of the photoreceptor 10.

Next, a toner cartridge according to the exemplary embodiment will be described.

The toner cartridge according to the exemplary embodiment is a toner cartridge including a toner container which stores the electrostatic charge image developing toner according to the exemplary embodiment and is detachable from the image forming apparatus.

EXAMPLE

Hereinafter, the invention is more specifically described with reference to examples and comparative examples, but the invention is not limited to examples below.

Example 1

Preparation of Toner Particles

The toner of Example 1 is obtained by the following method. That is, a resin particle dispersion, a colorant dispersion, and a release agent dispersion described below are respectively prepared. Subsequently, while these dispersions are mixed in respective predetermined amounts and stirred, a polymer of inorganic metal salt is added thereto, and ionically neutralized, and an aggregate of the respective particles is formed, so that a desired toner particle diameter is obtained. Subsequently, a pH value in a system is adjusted from a weak acidic range to a neutral range with inorganic hydroxide, and the resultant is heated to be equal to or greater than a glass transition temperature of the resin particles, to thereby be collectively coalesced. After the reaction, sufficient washing, solid-liquid separation, and a drying process are performed to obtain desired toner particles.

Synthesis of Crystalline Polyester Resin

In a flask, 1,982 parts by weight of sebacic acid, 1,490 parts by weight of ethyleneglycol, 59.2 parts by weight of sodium dimethyl isophthalate 5-sulfonate, and 0.8 parts by weight of dibutyltin oxide are reacted at 180° C. for 5 hours under a nitrogen atmosphere, and then the condensation reaction is performed at 220° C. under reduced pressure. Sampling is performed on the polymer in the middle of the reaction, and at the time when measurement by a gel permeation chromatography (GPC) exhibits an Mw (weight average molecular weight) of 20,000 and an Mn (number average molecular weight) of 8,500, the reaction is stopped, and the crystalline polyester resin is obtained. The dissolution temperature (peak temperature of DSC) is 71° C. The measurement result of the content of sodium dimethyl isophthalate 5-sulfonate by NMR is 1% by mole (with respect to all structural components).

Crystalline Polyester Resin Particle Dispersion 160 parts by weight of a crystalline polyester resin, 233 parts by weight of ethyl acetate, and 0.1 parts by weight of a sodium hydroxide aqueous solution (0.3 N) are prepared, these are put into a separable flask, heated to 75° C., and stirred with a three-one motor (manufactured by Shinto Scientific Co., Ltd.), to thereby prepare a resin mixture solution. While the resin mixture solution is further stirred, 373 parts by weight of ion exchange water is slowly added, phase inversion emulsification is performed, the temperature is dropped to 40° C. at a temperature dropping rate of 10° C./min, and the solvent is removed, thereby obtaining a crystalline polyester resin particle dispersion (solid content concentration: 30% by weight).

Synthesis of Amorphous Polyester Resin

After dimethyl terephthalate of 200 parts by weight, 1,3-butanediol of 85 parts by weight, and dibutyltin oxide of 0.3 parts by weight, as a catalyst, are put to a heated and dried two-necked flask, the air in the container is substituted to be in an inert atmosphere with nitrogen gas by a decompression operation, and stirring is performed by mechanical stirring at 180 rpm for 5 hours. Thereafter, the temperature is slowly increased to 230° C. under reduced pressure, the contents of the flask is stirred for 2 hours, air-cooled, and at the time when the resultant becomes a viscous state, the reaction is stopped, whereby 240 parts by weight of an amorphous polyester resin (amorphous polyester resin including acid-derived structural component in which content of aromatic dicarboxylic acid-derived structural component is 100 structure mole %, and alcohol-derived structural component in which content of aliphatic diol-derived structural component is 100 structure mole %) is synthesized.

As a result of the measurement by GPC (polystyrene conversion), the weight average molecular weight (Mw) of the obtained amorphous polyester resin (1) is 9,500, and the number average molecular weight (Mn) thereof is 4,200. Also, the DSC spectrum of the amorphous polyester resin (1) is measured by using the differential scanning calorimeter (DSC) described above, to observe the stepwise endothermic quantity change without clear peaks. The glass transition temperature obtained from the intermediate point of the stepwise endothermic quantity changes is 55° C. In addition, the resin acid value is 13 mgKOH/g.

Amorphous Polyester Resin Particle Dispersion

An amorphous polyester resin (1) of 160 parts by weight, ethyl acetate of 233 parts by weight, and an aqueous sodium hydroxide solution (0.3N) of 0.1 parts by weight are prepared, these are put to a separate flask and heated to 70° C., stirred with a three-one motor (manufactured by Shinto Scientific Co., Ltd.), and the resin mixture solution is prepared. While the resin mixture solution is further stirred, the ion exchange water of 373 parts by weight is slowly added, phase inversion emulsification is performed, the temperature is dropped to 40° C. at a temperature dropping rate of 1° C./min, and the solvent is removed, thereby obtaining an amorphous polyester resin particle dispersion (solid content concentration: 30% by weight).

Preparation of Colorant Dispersion

Cyan pigment (C. I. Pigment Blue 15:3, manufactured by Dainichiseika Color & Chemicals Mfg., Co., Ltd.): 45 parts by weight Ionic surfactant (NEOGEN RK, manufactured by Daiichi Kogyo Seiyaku Co., Ltd.): 5 parts by weight Ion exchange water: 200 parts by weight These are mixed and dissolved, the resultant is dispersed for 10 minutes with a homogenizer (IKA ULTRA-TURRAX), and the colorant dispersion with a volume average particle diameter of 170 nm is obtained.

In the same manner as in the dispersion above preparation of the dispersion of the cyan pigment, a yellow pigment (C. I. Pigment Yellow 74, manufactured by Dainichiseika Color & Chemicals Mfg., Co., Ltd.), a magenta pigment (C. I. Pigment Red 269, manufactured by Dainichiseika Color & Chemicals Mfg., Co., Ltd.), and a black pigment (C. I. Pigment Black 7, manufactured by Mitsubishi Chemical Corporation) are used to obtain respective colorant dispersions.

Preparation of Release Agent Dispersion

Alkyl wax FNP0085 (dissolution temperature of 86° C., manufactured by Nippon Seiro Co., Ltd.) 45 parts by weight Cationic surfactant (NEOGEN RK, manufactured by Daiichi Kogyo Seiyaku Co., Ltd.): 5 parts by weight Ion exchange water: 200 parts by weight The above materials are mixed, heated to 90° C., sufficiently dispersed in IKA ULTRA-TURRAX T50, and a dispersion process with a pressured discharge-type GAULIN homogenizer is performed, to thereby obtain a release agent dispersion with a volume average particle diameter of 200 nm and a solid content of 24.3% by weight.

Preparation of Toner

Crystalline polyester resin particle dispersion: 15 parts by weight

Amorphous polyester resin particle dispersion: 80 parts by weight

Colorant dispersion (respectively for Y, M, C, and K): 18 parts by weight

Release agent dispersion: 18 parts by weight

Ion exchange water is added to the components described above such that the solid content becomes 16% by weight, and the resultant is sufficiently mixed and dispersed with ULTRA-TURRAX T50 in a round stainless steel flask. Subsequently, poly aluminum chloride of 0.36 parts by weight is added thereto, and the dispersion operation is continued with ULTRA-TURRAX. The flask is heated to 47° C. in a hot oil bath under stirring. After being held at 47° C. for 60 minutes, amorphous polyester resin particle dispersion of 46 parts by weight is slowly added thereto. Thereafter, pH in the system is adjusted to 9.0 by using 0.55 mol/L of a sodium hydroxide aqueous solution, the stainless steel flask is sealed, the contents is heated to 90° C. while continuing stirring by using a magnetic seal, and held for 3.5 hours. Then, when the particle diameters are measured, the volume average particle diameter is 2.3 μm, the volume average particle size distribution index GSDv is 1.24, and the number average particle size distribution index GSDp is 1.30. After the above procedure, cooling and filtration are performed, sufficient washing with ion exchange water is performed, and solid-liquid separation is performed by Nutsche suction filtration. The resultant is re-dispersed in 3 L of ion exchange water at 40° C. and stirred and washed for 15 minutes at 300 rpm. The solid-liquid separation and re-dispersion are further repeated 5 times. At the time when the electric conductivity of the filtrate becomes 9.7 μS/cm, solid-liquid separation is performed using a No. 4A paper filter by Nutsche suction filtration.

Surface Modification of Toner Particles 100 parts by weight of the obtained toner particles are added to 900 parts by weight of ion exchange water to thereby prepare a slurry (solid content concentration of 10% by weight). 1 N hydrochloric acid is added to the slurry to adjust the pH to pH 4, stirring is performed for 10 minutes, the solid-liquid separation is performed by centrifugation, a supernatant liquid is taken out, and excessive acids are removed. Subsequently, 900 parts by weight of ion exchange water is added thereto to perform a re-slurry process, 10 parts by weight of a 10 wt % aqueous solution of UNISENSE KHP20LU (manufactured by SENKA Corporation, counter ion: acetate ion, aqueous solution having a pH of 10) being a DCDA/DETA polymer is added to this slurry, and the mixture is stirred for 60 minutes. Next, solid-liquid separation is performed by centrifugation, the supernatant solution is removed, and an extra DCDA/DETA polymer is removed. Until electric conductivity of the washing solution becomes equal to or less than 20 μS/cm, addition of ion exchange water, stirring for 10 minutes, and centrifugation are repeated. The mixture is washed with ion exchange water after being filtered using filter paper (No4A, manufactured by Advantech Co., Ltd.), dried at 35° C. for 24 hours (moisture content: 0.5% by weight), and then pulverized, thereby obtaining surface modified toner particles.

Preparation of Liquid Developer 100 parts by weight of the obtained surface modified toner particles are mixed with 233 parts by weight of silicone oil (dimethyl silicone 20 cs, manufactured by Shin-Etsu Chemical Co., Ltd.), to thereby obtain a liquid developer with the solid content concentration of 30% by weight.

Detection of DCDA/DETA Polymer

A DCDA/DETA polymer in surface modified toner particles is detected using an infrared spectrophotometer (FT/IR-4100, manufactured by JASCO Corporation). In infrared absorption spectra, the DCDA/DETA polymer has absorption characteristics in which the absorption of CN is in the vicinity of 1340-1250 $cm^{-1}$, the absorption of $NH_2$ is in the vicinity of 3500-3300 $cm^{-1}$ and 1640-1550 $cm^{-1}$, the absorption of NH is in the vicinity of 3500-3300 $cm^{-1}$, 1650-1590 $cm^{-1}$, and 900-650 $cm^{-1}$. Further, the presence of the DCDA/DETA polymer on the surface of toner particles is confirmed using a UV-visible near infrared spectrophotometer (VU-1800 type, manufactured by Shimadzu Corporation) by allowing fluorescein isothiocyanate (FITC) which is a fluorescent dye to be adsorbed by the DCDA/DETA polymer present on the surface of the toner particles.

In addition, the surface modified toner particles may be collected from a liquid developer by the following method. The liquid developer is precipitated by centrifugation (3,000 rpm×5 minutes), the supernatant liquid is taken out by decantation, and the toner particles are collected. The DCDA/DETA polymer on the surface of toner particles is separated by washing the collected toner particles with alcohols, and from the liquid after washing, the weight average molecular weight Mw of the DCDA/DETA polymer is determined, using a high performance liquid chromatography (HLC-8320GPC type, manufactured by TOSOH CORPORATION), the content of the DCDA/DETA polymer is determined using a UV-visible near infrared spectrophotometer (VU-1800 type, manufactured by Shimadzu Corporation), and the acid value of the binder resin is determined using a potential difference titration device (COM-1700 type, manufactured by HIRANUMA SANGYO Co., Ltd.) in conformity with a method of JIS K0070. The acid value of the binder resin is 13 mgKOH/g. The counter ion of the DCDA/DETA polymer is measured using an ion analyzer (IA-300 type, manufactured by DKK-TOA CORPORATION).

Evaluation

Developing Properties

Using each of the liquid developers obtained in examples and comparative examples, a liquid developer layer is formed on the developing roller of the image forming apparatus by using the image forming apparatus illustrated in FIG. 1. Subsequently, the developing roller and the photoreceptor are substantially uniformly charged so that the surface potential of the developing roller is set to be 300 V and the surface potential of the of the photoreceptor is 500 V, respectively, exposure is performed on the photoreceptor, and the charge on the surface of the photoreceptor is attenuated so that the surface potential becomes 50 V. After the liquid developer layer passes through a portion between the photoreceptor and the developing roller, the toner particles on the developing roller and the toner particles on the photoreceptor are collected with a tape, respectively. The tape used in the collection is attached to a recording paper to measure the concentration of the toner particles. After the measurement, value obtained by multiplying value obtained by dividing the concentration of the toner particles collected from the photoreceptor by the sum of the concentration of the toner particles collected from the photoreceptor and the concentration of the toner particles collected from the developing roller by 100 is referred to as development efficiency to evaluate the value based on the following five-grade criteria. The results are presented in Table 1.

A: Development efficiency is equal to or greater than 96%, and development efficiency is especially excellent B: Development efficiency is equal to or greater than 91% and less than 96%, development efficiency is excellent C: Development efficiency is equal to or greater than 85% and less than 91%, there is no problem in practical use D: Development efficiency is equal to or greater than 55% and less than 85%, development efficiency is inferior E: Development efficiency is less than 55%, development efficiency is especially inferior Positive Charging Properties With respect to each of the liquid developers obtained in the respective examples and respective comparative examples, the potential difference is measured by using a "microscope type laser zeta-potential meter" ZC-3000 manufactured by Microtec Nition Co., Ltd. to evaluate the potential difference based on the following five-grade criteria. The measurement is carried out by diluting the liquid developer with a diluent solvent, placing the dilution in a 10-mm square transparent cell, applying a voltage of 300 V at a gap between electrodes of 9 mm, and simultaneously observing the speed of movement of the particles in the cell with a microscope. Thus, the speed of movement is calculated, and the zeta potential is determined from the speed of movement value. The results are presented in Table 1.

A: Potential difference is equal to or greater than +100 mV (very good)

B: Potential difference is equal to or greater than +85 mV and less than +100 mV (good)

C: Potential difference is equal to or greater than +70 mV and less than +85 mV (mediocre)

D: Potential difference is equal to or greater than +50 mV and less than +70 mV (slightly poor)

E: Potential difference is less than +50 mV (very poor)

Dispersion Stability

Each of the liquid developers of 10 mL obtained in the respective examples and respective comparative examples is put into a test tube (diameter of 12 mm and length of 120 mm), and depths of the precipitation after the resultant is stood for 14 days is measured to evaluate the values based on the following five-grade criteria. The results are presented in Table 1.

A: Precipitation depth is 0 mm

B: Precipitation depth is greater than 0 mm and equal to or less than 2 mm

C: Precipitation depth is greater than 2 mm and equal to or less than 4 mm

D: Precipitation depth is greater than 4 mm and equal to or less than 6 mm

E: Precipitation depth is greater than 6 mm

Recycling Property

Each of the liquid developers obtained in the respective examples and respective comparative examples is used, and an image of predetermined pattern is formed on 50,000 sheets of recording paper (High quality paper $C^2$ manufactured by Fuji Xerox Co., Ltd.) by the image forming apparatus as illustrated in FIG. 1. The image is formed while the supply of the liquid developers from the liquid developer tanks of the respective colors to corresponding stirring devices of the respective colors is stopped. After the image is formed on the 50,000 sheets of recording paper, a test is performed on a recycled liquid developer obtained by diluting the toner particles collected in the stirring devices with an insulating liquid so that the solid content ratio become 30% by weight, according to the following method, and the adaptability to recycling (recycling properties) is evaluated.

With respect to each of the recycled liquid developers obtained in the respective examples and respective comparative examples, 10 mL of the recycled liquid developer is put into a test tube (diameter of 12 mm and length of 120 mm), and depths of the precipitation after the resultant is stood for 10 days is measured to evaluate the value based on the following five-grade criteria. The results are presented in Table 1.

A: Precipitation depth is equal to or less than 1 mm

B: Precipitation depth is greater than 1 mm and equal to or less than 3 mm

C: Precipitation depth is greater than 3 mm and equal to or less than 5 mm

D: Precipitation depth is greater than 5 mm and equal to or less than 7 mm

E: Precipitation depth is greater than 7 mm

Example 2

Surface modified toner particles and a liquid developer are obtained in the same manner as in Example 1 except that the amount of a 10 wt % aqueous solution of UNISENSE KHP20LU of a DEDA/DETA polymer to be used is changed to 2 parts by weight. Hereinafter, evaluations are performed in the same manner as in Example 1. The results are shown in Table 1.

Example 3

Surface modified toner particles and a liquid developer are obtained in the same manner as in Example 1 except that the amount of a 10 wt % aqueous solution of UNISENSE KHP20LU being a DEDA/DETA polymer to be used is changed to 30 parts by weight. Hereinafter, evaluations are performed in the same manner as in Example 1. The results are shown in Table 1.

Example 4

Surface modified toner particles and a liquid developer are obtained in the same manner as in Example 1 except that the DCDA/DETA polymer is changed to UNISENSE KHP21LU (manufactured by SENKA Corporation, counter ion: phosphate ion, aqueous solution having a pH of 10). Hereinafter, evaluations are performed in the same manner as in Example 1. The results are shown in Table 1.

Example 5

The surface modified toner particles and the liquid developer are obtained in the same manner as in Example 1 except that the binder resins of the toner particles are changed to a styrene/acrylic resin (manufactured by Fujikura kasei Co., Ltd., weight average molecular weight of 6,500). Hereinafter, evaluations are performed in the same manner as in Example 1. The results are presented in Table 1. The acid value of the binder resin is 10 mgKOH/g.

Example 6

Surface modified toner particles and a liquid developer are obtained in the same manner as in Example 1 except that the amount of a 10 wt % aqueous solution of UNISENSE KHP20LU being a DEDA/DETA polymer to be used is changed to 1 part by weight. Hereinafter, evaluation is performed in the same manner as in Example 1. The results are shown in Table 1.

Example 7

Surface modified toner particles and a liquid developer are obtained in the same manner as in Example 1 except that the amount of a 10 wt % aqueous solution of UNISENSE KHP20LU being a DEDA/DETA polymer to be used is changed to 50 parts by weight. Hereinafter, evaluation is performed in the same manner as in Example 1. The results are shown in Table 1.

Example 8

Surface modified toner particles and a liquid developer are obtained in the same manner as in Example 1 except that the DCDA/DETA polymer is changed to UNISENSE KHP10LU (manufactured by SENKA Corporation, counter ion: sulfate ion, aqueous solution having a pH of 7). Hereinafter, evaluation is performed in the same manner as in Example 1. The results are shown in Table 1.

Example 9

Surface modified toner particles and a liquid developer are obtained in the same manner as in Example 1 except that a DCDA/DETA polymer is changed to UNISENSE KHP11LU (manufactured by SENKA Corporation, counter ion: sulfate ion, aqueous solution having a pH of 7). Hereinafter, evaluations are performed in the same manner as in Example 1. The results are shown in Table 1.

Example 10

The surface modified toner particles and the liquid developer are obtained in the same manner as in Example 1 except that the amorphous polyester resin is synthesized as follows. In a reaction vessel, 618 parts by weight (11.0 mol) of a propylene oxide adduct of bisphenol A adducted with 2 moles of propylene per bisphenol A, 162 parts by weight (2.5 mol) of a propylene oxide adduct of bisphenol A adducted with 3 moles of propylene per bisphenol A, a terephthalic acid of 241 parts by weight (9.0 mol), an isophthalic acid of 13 parts by weight (0.5 mol), an adipic acid of 12 parts by weight (0.5 mol), and titanium diisopropoxy bis triethanolaminate of 3 parts by weight as a condensation catalyst are put, reaction is performed for 5 hours at 230° C. under a nitrogen gas flow while generated water is distilled, reaction is then performed under reduced pressure in the range of from 0.5 kPa to 2.5 kPa, and cooling is performed to 175° C. at the time when the acid value is equal to or less than 2 mgKOH/g. Thereafter, an anhydrous trimellitic acid of 9 parts by weight (0.3 mol) is put, the obtained mixture is held for 1 hour at 175° C., and collected. The obtained resin is cooled to the room temperature, and pulverized into particles. The glass transition temperature, the weight average molecular weight, and the resin acid value are measured in the same manner as in Example 1. The glass transition temperature is 58° C., the weight average molecular weight is 4,800, and the resin acid value is 1 mgKOH/g. Hereinafter, evaluations are performed in the same manner as in Example 1. The results are shown in Table 1.

Example 11

The surface modified toner particles and the liquid developer are obtained in the same manner as in Example 1 except that the amorphous polyester resin is synthesized as follows. In a reaction vessel, 601 parts by weight (20.0 mol) of ethyleneglycol, 470 parts by weight (5.0 mol) of terephthalic acid dimethyl ester, 402 parts by weight (5.0 mol) of isophthalic acid, and 3 parts by weight of tetraisopropoxide titanate as a condensation catalyst are put, and reaction is performed for 6 hours at 180° C. under a nitrogen gas flow while generated methanol is distilled. Subsequently, while the temperature is slowly increased to 230° C., and generated ethyleneglycol and water are distilled under a nitrogen gas flow, the reaction is performed for 4 hours, and reaction is performed for 2 hours under reduced pressure in the range of from 0.5 kPa to 2.5 kPa. The collected ethyleneglycol is 277 parts by weight (9.2 mol). Thereafter, cooling is performed to 175° C., 43 parts by weight (0.5 mol) of anhydrous trimellitic acid is put thereto, the obtained mixture is held for 1 hour at 175° C., and collected. The obtained resin is cooled to the room temperature, and pulverized into particles. The glass transition temperature, the weight average molecular weight, and the resin acid value are measured in the same manner as in Example 1. The glass transition temperature is 57° C., the weight average molecular weight is 5,800, and the resin acid value is 30 mgKOH/g. Hereinafter, evaluations are performed in the same manner as in Example 1. The results are shown in Table 1.

Example 12

The surface modified toner particles and the liquid developer are obtained in the same manner as in Example 1 except that the amorphous polyester resin is synthesized as follows. In a reaction vessel, 721 parts by weight (10.4 mol) of an ethylene oxide adduct of bisphenol A adducted with 2 moles of ethylene oxide per bisphenol A, 353 parts by weight (10.0 mol) of terephthalic acid, and 3 parts by weight of dibutyltin oxide as a condensation catalyst are put, reaction is performed for 10 hours at 230° C. under a nitrogen gas flow while generated water is distilled, and reaction is performed under reduced pressure in the range of from 0.5 kPa to 2.5 kPa. The obtained resin is cooled to the room temperature, and pulverized into particles. The glass transition temperature, the weight average molecular weight, and the resin acid value are measured in the same manner as in Example 1. The glass transition temperature is 55° C., the weight average molecular weight is 5,000, and the resin acid value is 0.5 mgKOH/g. Hereinafter, evaluations are performed in the same manner as in Example 1. The results are shown in Table 1.

Example 13

The surface modified toner particles and the liquid developer are obtained in the same manner as in Example 1 except that the amorphous polyester resin is synthesized as follows. In a reaction vessel, 599 parts by weight (11.5 mol) of a propylene oxide adduct of bisphenol A adducted with 2 moles of propylene per bisphenol, a propylene oxide adduct of bisphenol A adducted with 3 moles of propylene per bisphenol, a terephthalic acid of 174 parts by weight (7.0 mol), an isophthalic acid of 25 parts by weight (1.0 mol), an adipic acid of 44 parts by weight (2.0 mol), and tetrabutoxy titanate of 3 parts by weight as a condensation catalyst are put, reaction is performed for 5 hours at 230° C. under a nitrogen gas flow while generated water is distilled, reaction is performed under reduced pressure in the range of from 0.5 kPa to 2.5 kPa, and cooling is performed to 170° C. when the acid value is 2 mgKOH/g. Thereafter, 60 parts by weight (2.1 mol) of anhydrous trimellitic acid is put thereto, the obtained mixture is held for 1 hour at 170° C., and collected. The obtained resin is cooled to the room temperature, and pulverized into particles. The glass transition temperature, the weight average molecular weight, and the resin acid value are measured in the same manner as in Example 1. The glass transition temperature is 56° C., the weight average molecular weight is 4,300, and the resin acid value is 35 mgKOH/g. Hereinafter, evaluations are performed in the same manner as in Example 1. The results are shown in Table 1.

Comparative Example 1

Toner particles and a liquid developer are obtained in the same manner as in Example 1 except that a DCDA/DETA polymer is not used. Hereinafter, evaluations are performed in the same manner as in Example 1. The results are shown in Table 1.

Comparative Example 2

A sample of a liquid developer is prepared and evaluations are performed in the same manner as in Example 1 except that 2 parts by weight of quaternary ammonium salts (BONTRON P-51, manufactured by Orient Chemical Industries Co., Ltd.) are used for yellow, magenta, and cyan pigments and 1 part by weight of quaternary ammonium salts is used for a black pigment in place of a DCDA/DETA polymer to be mixed with dried toner particles. The results are shown in Table 1.

Comparative Example 3

A liquid developer is obtained in the same manner as in Example 1 except that 1 part by weight of ANTARON V220 (manufactured by ISP, Inc., weight average molecular weight: 8600) which is an α-olefin/vinylpyrrolidone copolymer is added to silicone oil in place of a DCDA/DETA polymer. Hereinafter, evaluations are performed in the same manner as in Example 1. The results are shown in Table 1.

Preparation of Dry Developer

Example 14

A dry developer is obtained by mixing 10 parts by weight of surface modified toner particles obtained in Example 1 with 190 parts by weight of a carrier for positive charging (Standard carrier P-01 of The Imaging Society of Japan).

Comparative Example 4

The dry developer is obtained by mixing 10 parts by weight of the toner particles obtained in Comparative Example 1 with 190 parts by weight of a carrier for positive charging (Standard carrier P-01 of The Imaging Society of Japan).

Comparative Example 5

A dry developer is obtained by mixing 10 parts by weight of the surface modified toner particles obtained in Comparative Example 2 with 190 parts by weight of a carrier for positive charging (Standard carrier P-01 of The Imaging Society of Japan).

Developing Properties of Dry Developer

Each of the developers of Example 14 and Comparative Examples 4 and 5 is charged in a developing device of a reformed machine DOCUCENTRE COLOR 400CP manufactured by Fuji Xerox Co., Ltd. (a machine which is reformed so that a process speed of a fixing unit may be controlled by an external power controller) under the circumstance of 25° C. and 50% RH, 10,000 sheets of white solid images are printed on A4 paper (J paper) manufactured by Fuji Xerox Co., Ltd., a solid batch of 5 cm×2 cm is developed. A development toner image on a photoreceptor surface is collected by using adhesiveness on a surface of an adhesive tape, and a weight thereof (W1) is measured. Subsequently, the same development toner image is transferred to a surface of paper (J paper), and the weight (W2) of the transferred image is measured. From the results, the transfer efficiency is calculated by the expression below and is evaluated according to the evaluation criteria. The results are shown in Table 1.

$$\text{Transfer efficiency (\%)}=(W2/W1)\times 100$$

Evaluation Criteria of Development Efficiency

A: Transfer efficiency is equal to or greater than 95%

B: Transfer efficiency is equal to or greater than 87.5% and less than 95%

C: Transfer efficiency is equal to or greater than 80% and less than 87.5%

D: Transfer efficiency is less than 80%

Positive Charging Properties of Dry Developer

Each of the developers of Example 14 and Comparative Examples 4 and 5 is put in the developing device described above, a charge amount of the toner regulated by a regulation blade of the developing device and conveyed to the photoreceptor is evaluated by analyzing the toner on the developing roller. The charge amount is measured by an E-SPART analyzer manufactured by Hosokawa Micron Corp. A measurement condition is a suction flow rate of 0.2 liters/minute, dust collecting air flow rate of 0.6 liters/minute, and spraying nitrogen gas pressure of 0.02 MPa, a charge amount (Q/m) for each toner is measured, and charge amount distribution is calculated with 3,000 toners countered. The results are shown in Table 1.

With respect to the uniformity of charge amounts of toners, in a number distribution of a charge amount for each toner, as an absolute value of the difference between a charge amount having a maximum frequency (Q1/m1) and the value (Q2/m2) obtained by dividing total charge amount of the measured toners by measured counts (number of toners) is smaller, the distribution of the charge amount is uniform, and as the absolute value is larger, the distribution is not uniform.

Evaluation Criteria of Charge Characteristic

A: Absolute value of difference is less than 0.8

B: Absolute value of difference is equal to or greater than 0.8 and less than 1.0

C: Absolute value of difference is equal to or greater than 1.0 and less than 1.5

D: Absolute value of difference is equal to or greater than 1.5

TABLE 1

| | Binder resin | Acid value of resin [mgKOH/g] | Colorant | Surface treatment agent | Addition amount (% by weight with respect to toner) | Developing properties | Positive charging properties | Dispersion stability | Recycling properties |
|---|---|---|---|---|---|---|---|---|---|
| Example 1 | Polyester | 13 | YMCK | KHP20LU (pH = 10, acetate ion) | 1 | A | A | A | A |
| Example 2 | Polyester | 13 | YMCK | KHP20LU (pH = 10, acetate ion) | 0.2 | B | B | A | A |
| Example 3 | Polyester | 13 | YMCK | KHP20LU (pH = 10, acetate ion) | 3 | A | A | B | B |
| Example 4 | Polyester | 13 | YMCK | KHP21LU (pH = 10, phosphate ion) | 1 | B | A | A | A |
| Example 5 | Styrene/acryl | 10 | YMCK | KHP20LU (pH = 10, acetate ion) | 1 | B | B | B | B |
| Example 6 | Polyester | 13 | YMCK | KHP20LU (pH = 10, acetate ion) | 0.1 | C | C | B | B |
| Example 7 | Polyester | 13 | YMCK | KHP20LU (pH = 10, acetate ion) | 5 | B | B | C | C |
| Example 8 | Polyester | 13 | YMCK | KHP10LU (pH = 7, sulfate ion) | 1 | C | C | C | C |
| Example 9 | Polyester | 13 | YMCK | KHP11LU (pH = 7, sulfate ion) | 1 | C | C | C | C |
| Example 10 | Polyester | 1 | YMCK | KHP20LU (pH = 10, acetate ion) | 1 | B | B | C | C |
| Example 11 | Polyester | 30 | YMCK | KHP20LU (pH = 10, acetate ion) | 1 | B | B | C | C |
| Example 12 | Polyester | 0.5 | YMCK | KHP20LU (pH = 10, acetate ion) | 1 | C | C | C | C |
| Example 13 | Polyester | 35 | YMCK | KHP20LU (pH = 10, acetate ion) | 1 | C | C | C | C |
| Example 14 | Polyester | 13 | YMCK | KHP20LU (pH = 10, acetate ion) | 1 | A | A | — | — |
| Comparative Example 1 | Polyester | 13 | YMCK | — | — | E | E | E | E |
| Comparative Example 2 | Polyester | 13 | YMCK | BONTRON P-51 | 2(YMC), 1(K) | E | E | E | E |
| Comparative Example 3 | Polyester | 13 | YMCK | ANTARON V220 | 1 | D | D | D | D |

TABLE 1-continued

| | Binder resin | Acid value of resin [mgKOH/g] | Colorant | Surface treatment agent | Addition amount (% by weight with respect to toner) | Developing properties | Positive charging properties | Dispersion stability | Recycling properties |
|---|---|---|---|---|---|---|---|---|---|
| Comparative Example 4 | Polyester | 13 | YMCK | — | — | D | D | — | — |
| Comparative Example 5 | Polyester | 13 | YMCK | BONTRON P-51 | 2(YMC), 1(K) | D | D | — | — |

As shown above, positive charging properties are excellent in Examples in which toner particles whose surface is treated by a polymer (DCDA/DETA polymer) of a monomer containing dicyandiamide and diethylenetriamine compared to those in Comparative Examples, particularly, the case where an α-olefin/vinylpyrrolidone copolymer is adhered to the surface of toner particles in Comparative Example 3. Further, developing properties, dispersion stability, and recycling properties in Examples are excellent compared to those in Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle that contains a binder resin and is surface-modified by a polymer obtained by polymerizing a monomer containing dicyandiamide and diethylenetriamine, wherein the toner particles have positive charge.

2. The electrostatic charge image developing toner according to claim 1, wherein an acid value of the binder resin is in a range of from 1 mgKOH/g to 30 mgKOH/g.

3. The electrostatic charge image developing toner according to claim 1, wherein a pH value of a solution where the polymer is dissolved in water exceeds 7.

4. The electrostatic charge image developing toner according to claim 1, wherein the polymer contains a counter ion, and the counter ion is at least one selected from the group consisting of an acetate ion and a phosphate ion.

5. The electrostatic charge image developing toner according to claim 1, wherein a molar ratio of the dicyandiamide to the diethylenetriamine is in a range of from 1:0.1 to 1:10.

6. The electrostatic charge image developing toner according to claim 1, wherein a content of the polymer is in a range of from 0.2% by weight to 3% by weight with respect to the entirety of the toner particles.

7. The electrostatic charge image developing toner according to claim 1, wherein the toner particle is surface-modified by the polymer which chemisorbs on the surface of the toner particles.

8. A liquid developer that contains a toner and a carrier liquid, wherein the toner is the electrostatic charge image developing toner according to claim 1.

9. The liquid developer according to claim 8, wherein an acid value of the binder resin of the toner particles is in a range of from 1 mgKOH/g to 30 mgKOH/g.

10. The liquid developer according to claim 8, wherein a pH value of a solution where the polymer of the toner particles is dissolved in water exceeds 7.

11. The liquid developer according to claim 8, wherein the polymer of the toner particle contains a counter ion, and the counter ion is at least one selected from the group consisting of an acetate ion and a phosphate ion.

12. The liquid developer according to claim 8, wherein a molar ratio of the dicyandiamide to the diethylenetriamine of the toner is in a range of from 1:0.1 to 1:10.

13. The liquid developer according to claim 8, wherein a content of the polymer of the toner particles is in a range of from 0.2% by weight to 3% by weight with respect to the entirety of the toner particles.

14. A toner cartridge that is detachable from an image forming apparatus, comprising a toner container which stores the electrostatic charge image developing toner according to claim 1.

15. The toner cartridge according to claim 14, wherein an acid value of the binder resin of the toner particles is in a range of from 1 mgKOH/g to 30 mgKOH/g.

16. The toner cartridge according to claim 14, wherein a pH value of a solution where the polymer of the toner particles is dissolved in water exceeds 7.

17. The toner cartridge according to claim 14, wherein the polymer of the toner particle contain a counter ion, and the counter ion is at least one selected from the group consisting of an acetate ion and a phosphate ion.

18. The toner cartridge according to claim 14, wherein a molar ratio of the dicyandiamide to the diethylenetriamine of the toner particles is in a range of from 1:0.1 to 1:10.

* * * * *